US006487758B2

(12) United States Patent
Shaffer et al.

(10) Patent No.: US 6,487,758 B2
(45) Date of Patent: Dec. 3, 2002

(54) POLYPROPYLENE RECLOSEABLE ZIPPER

(75) Inventors: Gregory Richard Shaffer, Martinsburg, WV (US); Charles Stempka, Mechanicsburg, PA (US); Lisa Mae Harris, Hagerstown, MD (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/814,040

(22) Filed: Mar. 21, 2001

(65) Prior Publication Data

US 2002/0133919 A1 Sep. 26, 2002

(51) Int. Cl.[7] ..... A44B 19/00; B65D 33/25; B65D 33/36

(52) U.S. Cl. ..... 24/585.12; 24/585.1; 383/63

(58) Field of Search ..... 24/585.12, DIG. 38, 24/DIG. 39; 383/63, 64, 65; 428/100

(56) References Cited

U.S. PATENT DOCUMENTS

| | | | | |
|---|---|---|---|---|
| 5,558,613 A | * | 9/1996 | Tilman et al. | 493/214 |
| 5,955,160 A | * | 9/1999 | Tanaka et al. | 383/63 X |
| 6,367,128 B1 | * | 4/2002 | Galkiewicz et al. | 24/585.1 |

FOREIGN PATENT DOCUMENTS

| | | | |
|---|---|---|---|
| EP | 0 330 171 A1 | 8/1989 | A44B/19/02 |
| EP | 0 345 930 A1 | 12/1989 | B65D/75/58 |
| EP | 0 345 930 B1 | 4/1992 | B65D/75/58 |
| EP | 0 731 033 A2 | 11/1992 | B65D/33/25 |
| EP | 0 731 033 A3 | 11/1992 | B65D/33/25 |
| EP | 0 530 470 A1 | 3/1993 | A44B/19/16 |
| EP | 0 530 470 B1 | 3/1993 | A44B/19/16 |
| EP | 0 330 171 B1 | 4/1993 | A44B/19/02 |
| EP | 0 632 974 B1 | 1/1995 | A44B/19/00 |
| EP | 0 632 974 A1 | 1/1995 | A44B/19/00 |
| EP | 0 814 026 A3 | 6/1996 | B65D/33/25 |
| EP | 0 814 026 A2 | 6/1996 | B65D/33/25 |
| EP | 0 731 033 B1 | 9/1996 | B65D/33/25 |
| WO | WO 98/24704 | 6/1998 | B65D/33/25 |

* cited by examiner

*Primary Examiner*—Robert J. Sandy
(74) *Attorney, Agent, or Firm*—Daniel S. Kalka; Loren H. Uthoff, Jr.

(57) ABSTRACT

A polypropylene closure arrangement for flexible packages comprises a blend having a polypropylene random copolymer as a base resin with a flexible modifier, and a slip component. The polypropylene closure arrangement 10, 110 is sufficiently flexible to be extruded and coiled around guide wheels similar to the fusion process of a polyethylene closure arrangement. The polypropylene closure arrangement in accordance with the present invention has the ability to be fusibly attached to a polypropylene film or other fusibly compatible thermoplastic material launch conditions.

10 Claims, 1 Drawing Sheet

POLYPROPYLENE RECLOSEABLE ZIPPER

BACKGROUND OF THE INVENTION

1. Field of the Invention

The present invention relates in general to a polypropylene recloseable zipper, and in particular to a polypropylene recloseable zipper for flexible bags or packages that are resealable.

2. Description of the Related Art

The term "zipper" as used herein is intended to encompass any closure arrangement for a bag or package. These bags are used in a wide variety of consumer packaging applications and are usually made from a polymeric or thermoplastic material. The zipper is usually located on one side near the edge and has two strips with profiles, such as complementary projections and grooves, that are constructed to interlock with proper alignment. The recloseable zipper allows the bag to be resealable when contents are removed or added. The zipper is preferably flexible as is the bag and is firmly attached to the bag. While fusible attachment is the preferred attachment, there exist other ways of attaching the zipper to the bag, for example, by way of an adhesive or some anchoring means.

A thermal fusion process, also referred to herein as heat welding or simply welding, permanently attaches both strips making up the recloseable zipper to the bag or polymeric film used in forming the bag. The zipper attachment is often made prior to sealing and cutting of the film's side walls to form the finished bag.

As is known in this industry, a proper fused attachment of the zipper to the bag ensures seal tightness and avoids any separation of the zipper from the bag.

Polyethylene is widely used in resealable bags or packages and is usually employed both for the bag or package film material as well as for the extruded strips which make up the zipper. The polyethylene material extrudes easily, is flexible, and heat welds to the film material at a reasonable temperature. Thermal fusion of zippers to film material is done in a manner to provide sufficient heat to bond the zipper to the film, yet not at a temperature that causes thermal deformation of the zipper or film material.

It is further known in the industry that some materials are fusibly incompatible. While polyethylene may be fused to polyethylene, it cannot be directly fused to polypropylene. Some packaging applications require a polypropylene film material to function as a more active fluid barrier. In order to fuse or heat seal polyethylene to polypropylene, the industry practice is to place a tie layer of ethylene vinyl acetate (EVA), or some other accelerant, to the weld area of the polypropylene film. The EVA acts as the tie layer for welding the polyethylene zipper to the polypropylene film. The co-extrusion process associated with making those materials of the prior art approach is expensive, time consuming, and requires application of the accelerant to a large weld area for the process to work effectively.

U.S. Pat. No. 4,807,300 recognizes the problems of fused attachment of the zipper strips to a fusibly incompatible material and addresses this problem with a different approach. This patent describes a particular anchor-socket arrangement. Fused connecting anchors extend through holes in the bag material.

There still exists a need for a polypropylene closure arrangement or recloseable zipper which is sufficiently flexible to be extruded in a similar manner as polyethylene, and still allow the recloseable zipper to be directly fused or heat welded to the polypropylene film for making a resealable polypropylene package.

BRIEF SUMMARY OF INVENTION

Accordingly, an object of the present invention is to provide a polypropylene zipper that may be attached by heat welding or fusion directly to the polypropylene film.

Another object of the present invention is to provide a polypropylene zipper with sufficient flexibility during the processing to be extruded and still have the ability to heat weld to a polypropylene film at reasonable temperatures without a tie layer or accelerant.

Another object of the present invention is to provide an extruded polypropylene zipper fabricated from a polypropylene random copolymer base resin.

Another object of the present invention is to provide a recloseable zipper which uses a homogenized blend of resin component which is directly weldable to polypropylene film.

Still another object of the present invention is to provide a closure arrangement for a resealable polypropylene bag that includes strips smaller in width than a polyethylene closure arrangement having a tie layer or accelerant co-extruded therein.

The above and other objects are accomplished with a polypropylene zipper comprising a blend of polypropylene, a flexible modifier, and a slip component. Preferably, the polypropylene zipper comprises a blend of about 78% on a weight percent basis polypropylene, about 20% on a weight percent basis flexible modifier, and about 2% on a weight percent basis slip component. The polypropylene is preferably a random copolymer polypropylene. The flexible modifier is preferably an ethylene copolymer. The slip component preferably includes an oleamide functioning as a slip additive in a carrier resin of low density polyethylene (LDPE).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is described and illustrated.

DETAILED DESCRIPTION OF THE INVENTION

The term "recloseable zippers" as employed herein is intended to refer to a closure arrangement employed in resealable bags or packages where the closure arrangement is typically a pair of strips having an interlocking profile extruded from a thermoplastic or polymeric material. A pair of strips with complementary interlocking profiles are attached to a bag or package by way of a fused attachment, also referred to herein as thermal fusion, heat welding or simply welding. The welding technique is well known in the industry, but it is also well known that dissimilar materials are often fusibly incompatible. While polypropylene may be fused to polypropylene, and polyethylene may be fused to polyethylene, polypropylene may not be fused directly to polyethylene. Polyethylene is widely employed for the film material employed to make bags or packages. Polyethylene is also easily extrudable for the zipper. In some instances, it is desirable to use other bag materials like polypropylene where a better fluid barrier is required.

When a customer requests a polypropylene bag or package, the practice in the industry is to place a tie layer of ethylene vinyl acetate (EVA) or some other accelerant known in the art on the weld area of the polypropylene film material. The EVA allows a polyethylene zipper to be heat welded to the polypropylene film.

In contrast to that prior art approach, the present invention utilizes a novel blend which has a polypropylene random copolymer as a base resin for the zipper. It was found that a 100% polypropylene zipper is too stiff for processing in a manner similar to a polyethylene zipper. Even if one were able to successfully extrude the 100% polypropylene zipper, it would require heat welding to the polypropylene film at relatively high temperatures as compared with a polyethylene zipper. As mentioned previously, high temperatures employed in the thermal fusion process can cause thermal deformation in the profiles in the zipper strips which then interferes with the interlocking of the strips. During the heat sealing of the zipper to the bag, it is often desirable that the temperature of the base portion of the profile that is in contact with the film material reach a point where the bag film and base portion fuse by melting slightly. Excessive melting may be problematic if profiles deform during the thermal fusion to the bag. Similarly, zippers having a pair of strips with small elements and close tolerances are vulnerable to deformation during this process. The polypropylene zipper in accordance with the present invention employs a formulation that allows for zipper flexibility in the extruding process as well as the ability to heat weld to a polypropylene film at temperatures similar to polyethylene zippers without any requirement for a tie layer.

Figure 1:
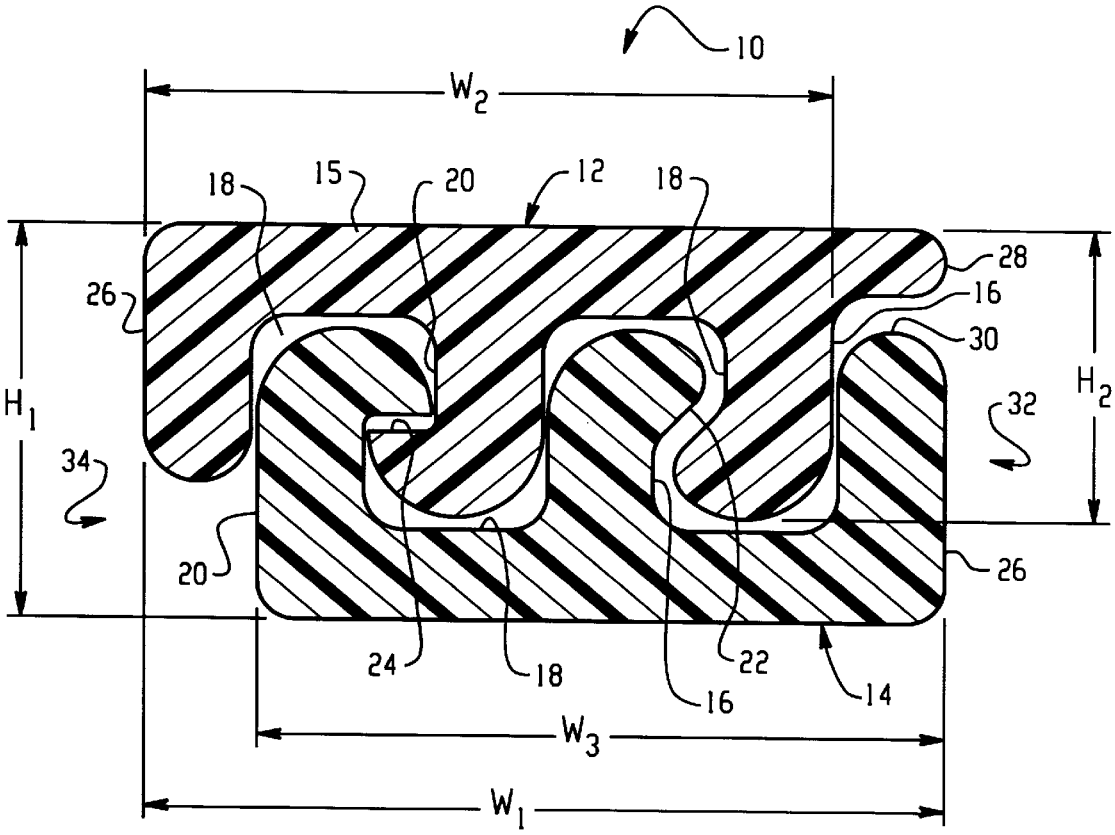
FIG. 1 is a sectional enlarged view of the preferred embodiment of a closure arrangement in accordance with the present invention.
Figure 2:
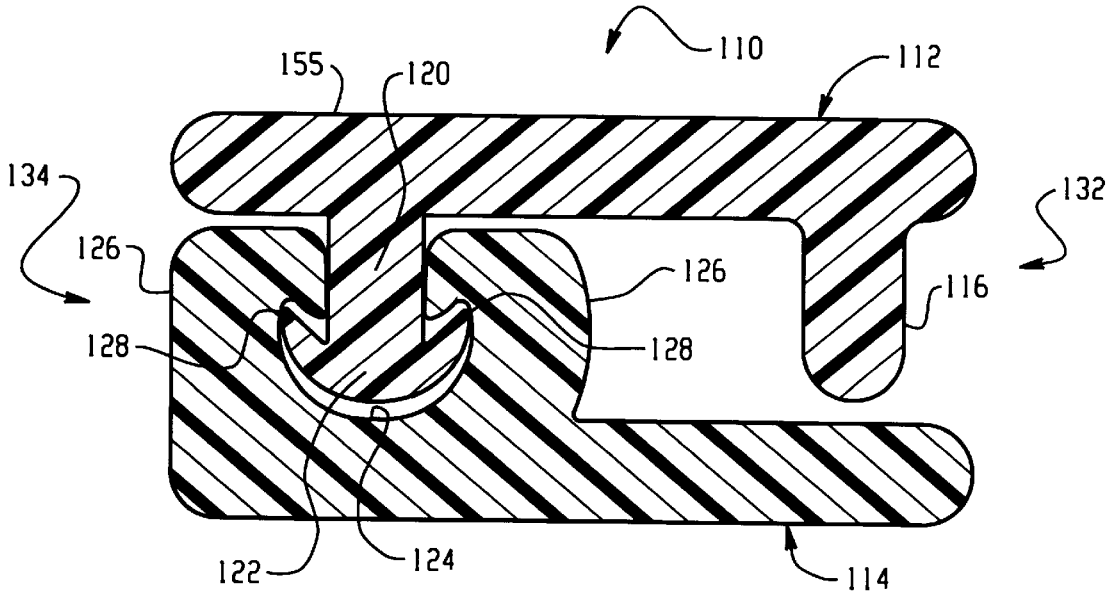
FIG. 2 is a sectional enlarged view of an alternate closure arrangement.

The recloseable polypropylene zipper according to the present invention comprises a resin blend which includes a polypropylene random copolymer as the base resin, a flexible modifier, and a special slip component. These components when blended together produce an extruded zipper that is sufficiently flexible to coil around guide wheels known in this industry when extruding polyethylene zippers, yet have the ability to be welded to a polypropylene film or material of a bag with the characteristic of having its interlocking profiles close together easily. The interlocking profiles of the resealable zipper 10 according to a preferred embodiment of the present invention is shown in FIG. 1, in a dimension of a greater scale than that employed in actual practice. FIG. 2 depicts an alternate embodiment. The profiles shown in FIGS. 1 and 2 will be described in greater detail later herein.

Preferably, the base resin as mentioned previously is a polypropylene random copolymer such as an Amoco Polypropylene 8244 which is commercially available in pellet form from Amoco Polymers.

The flexible modifier is preferably a semi-crystalline ethylene copolymer like a FLEXOMER®, polyolefin DFDB-1085 Natural or DFDA-1010 Natural 7, which are commercially available from Union Carbide Corporation in pellet form. Additionally, the blend of resin of the present invention uses a slip component, preferably a Techmer PM 1914E4 slip component that employs preferably oleamide as a slip additive in a carrier resin of low density polyethylene (LDPE). This component is also commercially available from Techmer PM LLC Polymer Modifiers. When these three components are blended together, polypropylene zipper strips can be extruded with sufficient flexibility and weldability to that of a polyethylene zipper.

Referring now to FIG. 1, there is shown an enlarged sectional view of a recloseable polypropylene zipper 10 made in accordance with the present invention. For purposes of providing a dimensional relationship of the view in FIG. 1 to an actual size, the scale is about 40 times that of the actual size. The recloseable zipper 10 preferably comprises two complementary strips, a first strip 12 and a second strip 14 which can extend longitudinally entirely across an intended opening of a resealable bag or film material to be fabricated into a bag. Strips 12, 14 are usually manufactured in bulk and coiled on rolls. Although reference will be made to strip 12 as being the upper strip and strip 14 the lower strip, it should be immediately apparent that these references may be reversed. Each strip 12, 14 has a longitudinally extending base portion 15 with a plurality of longitudinally continuously extending hook shaped projections 16 situated on each strip 12, 14 in a selected arrangement that allows each of the hook shaped projections 16 to be releasably interlocked within a complementary groove 18 on the opposite strip. Preferably, at least one of the projections in each strip 12, 14 is a locking projection 20. Projections 16 include a rounded shoulder portion 22 on one side thereof. The locking projection 20 further includes a lateral base 24 thereunder adapted to abut and engage a complementary lateral base 24 on a locking projection 20 from the other strip. In the preferred embodiment, the polypropylene recloseable zipper 10 comprises at least one post-like projection or rib 26 spaced apart from a projection 16, 20. The base portion 15 of strip 12 further includes an extending tab 28 that extends over a complementary rib 26 of strip 14. Tab 28 is spaced apart from an apex 30 of rib 26 to allow a user to separate the strips 12, 14 from one another on an easy open or user side 32 of the package or bag.

Strip 14 in the preferred embodiment includes an arrangement with a locking projection 20 constructed to be received within a groove 18 between rib 26 and complementary locking projection 20 on strip 12. The locking projection 20 on strip 14 is spaced apart and followed by hook shape projection 16 which is then followed by rib 26 in a spaced apart relationship on strip 14. When strip 14 and strip 12 are situated together in an interlocking arrangement as depicted in FIG. 1, the right hand side of the figure as it is viewed is the opening or user side 32 of the bag or package while the left hand side of the page is the product side or sealed side 34 of the package. As used herein, the term "product side" refers to the volume inside the package (not shown) between the closure mechanism 10. The right hand side as shown in FIG. 1 may also be referred to as the "consumer side". This is the region of the package accessible by the user by opening or closing the closure mechanism 10.

The following dimensions are being provided for illustrative purposes of the preferred embodiment of the present invention and are not intended to be limited thereto. The width W1 of the recloseable zipper 10 in its interlocked orientation is approximately 0.120 inches. The width W2 of strip 12 is approximately 0.110 inches, and the width W3 of strip 14 is also approximately 0.110 inches. The height of the recloseable zipper 10 in the interlocked orientation ranges from approximately 0.057 inches to 0.062 inches. The height H2 from the base 15 of strip 12 to the apex of projection 16 is approximately 0.045 inches.

Referring next to FIG. 2, there is shown an enlarged sectional view of another embodiment of the closure arrangement of a recloseable polypropylene zipper 110 according to the present invention. In this closure arrangement, there is a first strip 112, also referred to as an upper, and second strip 114, also referred to as a lower strip, that make up the completed polypropylene zipper 110. Preferably, in this embodiment, strip 112 includes a longitudinally extending base 115 with a post-like projection 116 and a locking projection 120 situated in a spaced apart relationship on one side of strip 112. Locking projection 120 at its distal end includes a mushroom shaped portion 122. The mushroom shaped portion 122 of locking projection 120 is received within a groove 124 formed between two clasping projections 126 situated in a spaced relationship that accommodates the mushroom shaped portion 122 of locking projection 120. Clasping projections 126 on strip 114 include hook-like portions 128 constructed to engage the upper portion 122 of locking projection 120. The alternate arrangement depicted in FIG. 2 has a user side 132 which is located on one side of the strip. The sealed side 134 is situated on the other side of the strip.

It should be understood that the recloseable polypropylene zipper in accordance with the present invention may be constructed in any form of closure arrangement suitable for sealing a polymeric or thermoplastic bag or package. The recloseable polypropylene zipper in accordance with the present invention is a homogenized blend of resin component that allows the zipper to be directly weldable to a polypropylene film or fusibly compatible thermoplastic material.

Advantageously, the polypropylene zipper in accordance with the present invention may be extruded similar to that of a polyethylene zipper and is less expensive than a co-extrusion process which is presently employed for a closure arrangement for a polypropylene material. As a further advantage, the dimensions of the polypropylene zipper of the present invention may be smaller than prior art closure arrangements and offers cost advantages and flexibility in packaging size designs over a co-extruded zipper used for a polypropylene film.

While the drawings refer to a recloseable polypropylene zipper, it should be immediately apparent that the present invention may also be applied to a sealed polypropylene zipper, or any type of polypropylene closure arrangement.

Reference is now made to the following chemical examples illustrative of the present invention. The present invention is not intended to be limited thereto.

EXAMPLE I

Approximately 78% on a weight percent basis of Amoco 8244 Polypropylene approximately 20% FLEXOMER® DFDB-1085, and about 2% on a weight percent basis of Techmer PM 1914E4 were blended, and heated to a temperature of approximately 440° F. and extruded under standard polyethylene extrusion conditions to produce a polypropylene zipper having a closure arrangement as depicted in FIG. 1.

EXAMPLE II

The polypropylene component such as Amoco 8244 can range on a weight percent basis from about 66% to about 84% of the blend. The flexible modifier such as Flexomer DFDA-1010 Natural 7 or DFDB-1085 content can range from about 15% to about 30% of the blend on a weight percent basis. The slip component such as Techmer PM 1914E4 may range from about 1% to about 4% of the blend on a weight percent basis.

While specific embodiments of the invention have been shown and described in detail to illustrate the application of the principles of the invention, it will be understood that the invention may be embodied otherwise without departing from such principles.

We claim:

1. A polypropylene zipper, comprising a blend of a polypropylene, a flexible modifier, and a slip component, said polypropylene ranging from about 66% to about 84% of the blend on a weight percent basis, said flexible modifier ranging from about 15% to about 30% of the blend on a weight percent basis and said slip component ranging from about 1% to about 4% of the blend on a weight percent basis.

2. A zipper according to claim 1, wherein said polypropylene zipper comprises about 78% on a weight percent basis polypropylene, about 20% on a weight percent basis flexible modifier, and about 2% on a weight percent basis slip component.

3. A zipper according to claim 2, wherein said polypropylene comprises a random copolymer polypropylene.

4. A zipper according to claim 3, wherein said flexible modifier comprises an ethylene copolymer.

5. A zipper according to claim 4, wherein said slip component comprises oleamide as a slip additive in a carrier resin of low density polyethylene.

6. A polypropylene zipper according to claim 1, wherein said zipper comprises:

a first engagement strip; and a second engagement strip, each of said first and second engagement strips having a plurality of projections situated in a spaced arrangement to define grooves therebetween, wherein one projection on said first engagement strip is received within a groove on said second engagement strip, and a projection on said second engagement strip is received by a groove on said first engagement strip.

7. A polypropylene zipper according to claim 6, wherein at least one of said plurality of projections on each of said first and second engagement strips comprises a locking projection.

8. A polypropylene zipper according to claim 7, wherein said locking projection on said first engagement strip is cooperatively received by a groove on said second engagement strip, said locking projection on said first engagement strip clasping said locking projection on said second engagement strip.

9. A polypropylene zipper according to claim 8, wherein said plurality of projections comprise three projections continuously extending axially on each of said first and second engagement strips, one of said three projections comprises said locking projection, another of said three projections having a contoured shoulder portion constructed to cooperatively receive and mesh with a like projection, and a third post-like projection extending in a substantially transverse direction.

10. A polypropylene zipper according to claim 9, wherein each of said first and second strips have said plurality of projections in a predetermined arrangement, said predetermined arrangement of said first strips comprises said first projection being said post-like projection, said second projection being said locking projection and said third projection having said contoured shoulder, and said predetermined arrangement of said second strip comprises said first projection being said locking projection, said second projection being said projection having said contoured shoulder, and said third projection being said post-like projection extending in a substantially transverse direction.

* * * * *